US007219658B2

(12) United States Patent
Torii

(10) Patent No.: US 7,219,658 B2
(45) Date of Patent: May 22, 2007

(54) FUEL FEED APPARATUS HAVING PUMP AND STAY

(75) Inventor: Mikio Torii, Hekinan (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/216,081

(22) Filed: Sep. 1, 2005

(65) Prior Publication Data

US 2006/0073029 A1 Apr. 6, 2006

(30) Foreign Application Priority Data

Oct. 4, 2004 (JP) ..... 2004-291195

(51) Int. Cl.
*F02M 37/04* (2006.01)
*F02M 37/08* (2006.01)

(52) U.S. Cl. ..... 123/509

(58) Field of Classification Search ..... 123/509, 123/510, 511, 514, 516; 137/571, 572, 574, 137/576

See application file for complete search history.

(56) References Cited

U.S. PATENT DOCUMENTS

| | | | | |
|---|---|---|---|---|
| 4,907,616 | A * | 3/1990 | Bergsma | 137/38 |
| 5,992,394 | A | 11/1999 | Mukaidani et al. | |
| 6,837,222 | B2 * | 1/2005 | Okazono et al. | 123/509 |
| 2004/0000516 | A1 * | 1/2004 | Okabe et al. | 210/416.4 |
| 2005/0166974 | A1 * | 8/2005 | Hashiguchi | 137/571 |

* cited by examiner

*Primary Examiner*—Mahmoud Gimie
(74) *Attorney, Agent, or Firm*—Nixon & Vanderhye PC

(57) ABSTRACT

A fuel feed apparatus includes a flange, a fuel pump, and a stay. The flange covers an opening of a fuel tank. The fuel pump is accommodated in the fuel tank. The fuel pump pumps fuel in the fuel tank to the outside of the fuel tank. The stay has a first end, which connects with the flange. The stay has a second end that supports the fuel pump in the fuel tank. The flange has a hole portion on the side of the fuel pump. The hole portion of the flange receives the first end of the stay on the opposite side of the fuel pump. The first end, which is received in the hole portion, has a rotation restricting portion that restricts the stay from rotating in the circumferential direction of the stay.

9 Claims, 6 Drawing Sheets

FUEL FEED APPARATUS HAVING PUMP AND STAY

CROSS REFERENCE TO RELATED APPLICATIONS

This application is based on and incorporates herein by reference Japanese Patent Application No. 2004-291195 filed on Oct. 4, 2004.

FIELD OF THE INVENTION

The present invention relates to a fuel feed apparatus that supplies fuel in a fuel tank to the outside of the fuel tank.

BACKGROUND OF THE INVENTION

Conventionally, a fuel feed apparatus has a fuel pump that is accommodated in a fuel tank. The fuel feed apparatus includes a flange that covers an opening of the fuel tank. The fuel pump is supported by the flange via a stay. The stay has an axial end that is press-inserted into a hole formed in the flange, for example.

A fuel feed apparatus disclosed in U.S. Pat. No. 5,992,394 (JP-A-11-101166) includes a sub-tank that accommodates a fuel pump. A stay connects the sub-tank with the flange. In this structure, the sub-tank is pressed onto a bottom wall of a fuel tank, so that the sub-tank is not apt to be twisted with respect to the flange. Therefore, force applied to the stay in the circumferential direction thereof becomes small.

However, when a pump is suspended from a flange into a fuel tank, or when force pressing a sub-tank onto a bottom wall of a fuel tank is small, the flange may be twisted with respect to the fuel pump in a fuel feed apparatus. Specifically, a stay connecting the flange with the sub-tank is substantially circular in cross section, and the flange has a circular hole, into which the stay is press-inserted. Accordingly, when the flange is twisted relative to the fuel pump, the stay circumferentially is rotated in the hole of the flange.

It is conceived to provide an additional component such as a pin or a ring to restrict rotation of the stay. However, when an additional component is provided, the number of components and manpower for assembling the fuel feed apparatus increases.

SUMMARY OF THE INVENTION

In view of the foregoing and other problems, it is an object of the present invention to produce a fuel feed apparatus, in which a stay is restricted from circumferentially rotating, without increasing a number of components and manpower for assembling the fuel feed apparatus.

According to one aspect of the present invention, a fuel feed apparatus includes a flange, a fuel pump, and at least one stay. The flange covers an opening of a fuel tank. The fuel pump is accommodated in the fuel tank. The fuel pump pumps fuel in the fuel tank to an outside of the fuel tank. The at least one stay has a first end, which connects with the flange. The at least one stay has a second end. The at least one stay supports the fuel pump in the fuel tank on the side of the second end. The flange has a hole portion on a side of the fuel pump. The hole portion of the flange receives the first end of the at least one stay. The first end of the at least one stay is located on an opposite side of the fuel pump. The first end received in the hole portion has a rotation restricting portion that restricts the at least one stay from rotating in a circumferential direction of the at least one stay.

The rotation restricting portion has a cross section, which is perpendicular to an axis of the at least one stay. The cross section of the rotation restricting portion is in a noncircular shape. The hole portion has a cross section that is substantially similar to the cross section of the rotation restricting portion. The cross section of the rotation restricting portion may be in a substantially oblong shape that has two sides, which are substantially in parallel with each other. The cross section of the rotation restricting portion may be in a substantially D-shape that is formed of an arc and a substantially straight line. Alternatively, the cross section of the rotation restricting portion may be in a substantially rectangular shape that is formed of two pairs of two sides, which are opposed to each other. In this case, the two sides, which are opposed to each other, are substantially in parallel with each other.

Therefore, the at least one stay is restricted from rotating by the rotation restricting portion, even when circumferential force acts onto the at least one stay. Thus, the at least one stay can be restricted from circumferentially rotating without providing an additional component.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS (First Embodiment)

Figure 1:
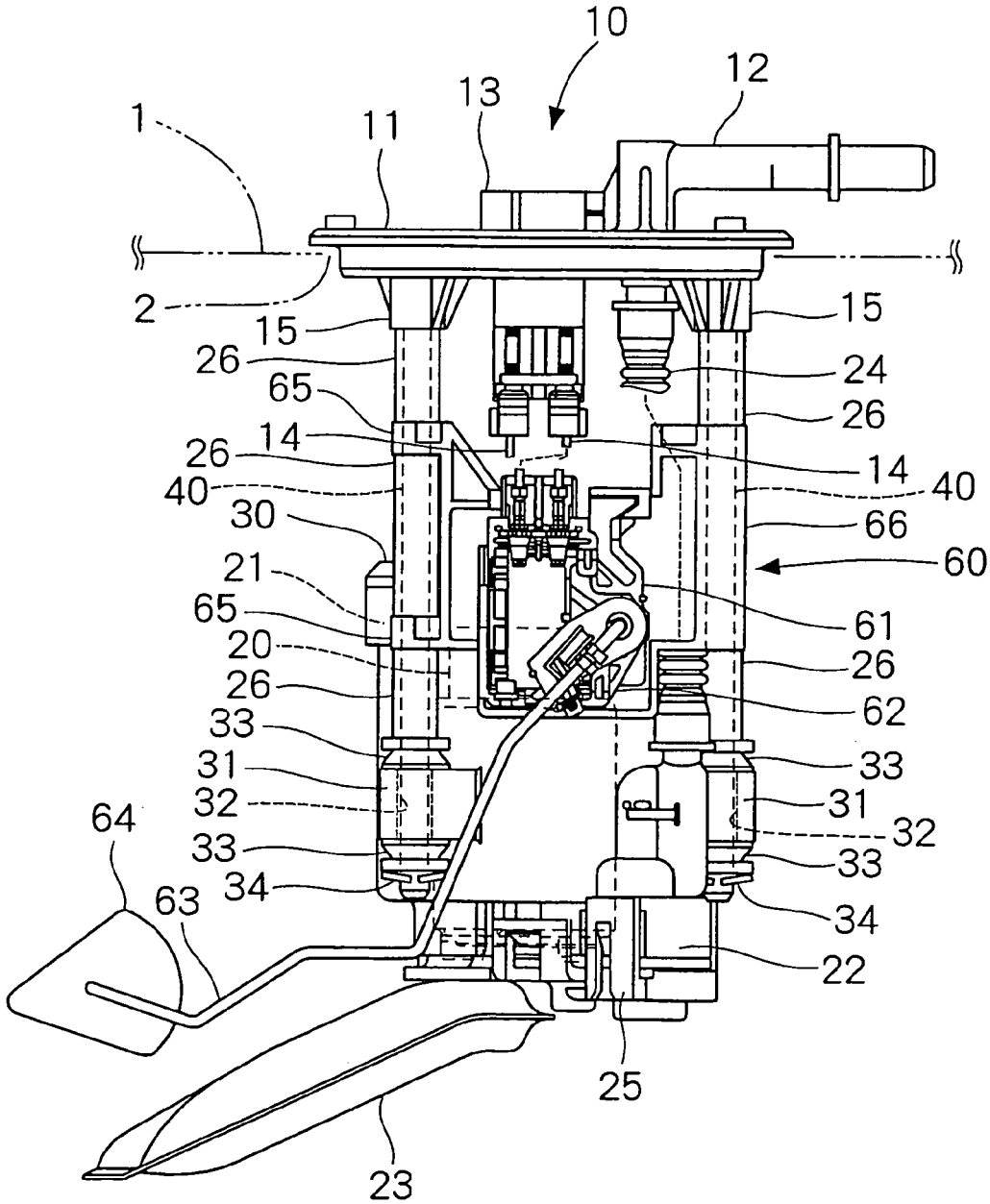
FIG. 1 is a side view showing a fuel feed apparatus according to a first embodiment of the present invention.

As shown in FIG. 1, a fuel feed apparatus 10 has a flange 11, which is formed in a circular disc-shape. The flange 11 is mounted to an upper wall of the fuel tank 1, so that the flange 11 covers an opening 2 formed in the fuel tank 1. Components of the fuel feed apparatus excluding the flange 11 is accommodated in the fuel tank 1. The flange 11 includes a discharge pipe 12 and an electric connector 13.

The components of the fuel feed apparatus 10 accommodated in the fuel tank 1 include a fuel pump 20, a fuel filter 21, a pressure regulator 22, and a suction filter 23. The fuel pump 20 is directly accommodated in the fuel tank 1. The fuel pump 20 draws fuel in the fuel tank 1. The fuel pump 20 accommodates a motor (not shown). The fuel pump 20 is energized, and the motor rotates an impeller (rotating member, not shown), so that suction force is generated to draw fuel in the fuel tank 1. Fuel discharged from the fuel pump 20 passes through the fuel filter 21. The fuel passing through the fuel filter 21 is controlled in pressure through the pressure regulator 22, subsequently the fuel is introduced to the outside of the fuel tank 1 though a bellows pipe 24 and a discharge pipe 12. The electric connector 13 connects with the fuel pump 20 via a lead wire 14.

The fuel filter 21 is arranged on the radially outer side of the fuel pump 20. The fuel filter 21 circumferentially covers the fuel pump 20. A suction filter 23 is provided on the suction side of the fuel pump 20. The suction filter 23 removes relatively large debris contained in fuel drawn into the fuel pump 20. The fuel filter 21 removes relatively small debris contained in fuel discharged from the fuel pump 20. A bracket 25 supports the fuel pump 20 from the lower side in FIG. 2.

The fuel filter may not be provided on the discharge side of the fuel pump 20. For example, when filtering performance of the suction filter 23 is improved to be capable of removing relatively small debris, the fuel filter 21 may be reduced.

The fuel feed apparatus 10 includes a case 30 that accommodates the fuel pump 20 and the fuel filter 21. The case 30 includes substantially cylindrical connecting portions 31 that respectively protrude outwardly from the case 30 in the radial direction of the case 30.

Figure 3:
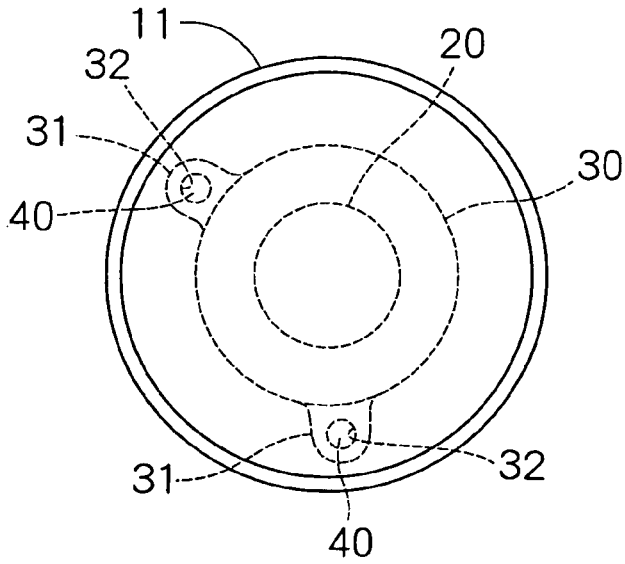
FIG. 3 is a top view showing the fuel feed apparatus according to the first embodiment.

As shown in FIG. 3, two of the connecting portions 31 are provided to the case 30 at two locations. An imaginary straight line, which connects the two connecting portions 31 is out of the center of the case 30, so that the connecting portions 31 are arranged at locations that are eccentric with respect to the case 30. As referred to FIG. 1, each connecting portion 31 has a hole portion 32 that axially penetrates the connecting portion 31.

Each stay 40 is formed in a bar shape. The stay 40 is formed of metal such as stainless steel and aluminum, or is formed of a non-metallic material such as resin. The stay 40 connects with the flange 11 and the case 30. The fuel pump 20 accommodated in the case 30 is supported by the flange 11 via two of the stays 40, so that the fuel pump 20 is suspended from the flange 11 into the fuel tank 1 via the stays 40. Each stay 40 has one end (first end) that is press-inserted into a press-inserted portion 15 of the flange 11. The stay 40 has the other end (second end) on the opposite side of the flange 11. The other end of the stay 40 extends into the fuel tank 1, so that the other end of the stay 40 is inserted into the hole portion 32 of the connecting portion 31.

As referred to FIG. 1, the connecting portion 31 has two axial ends, to which rings 33 are respectively provided. Each ring 33 is formed of an elastic material such as oil-proof rubber. The ring 33 is formed in a substantially cylindrical shape, into which the stay 40 is inserted. The stay 40 has a washer 34 on the axial end thereof on the side opposite to the flange 11. The stay 40 is inserted into the connecting portion 31, and is attached with the ring 33. The stay 40 is attached with the washer 34 on the axial end thereof, so that the stay 40 is supported by the case 30 that accommodates the fuel pump 20.

The fuel feed apparatus 10 includes a sender gauge 60 that detects a liquid level of fuel in the fuel tank 1. The sender gauge 60 is accommodated in the fuel tank 1 together with the fuel pump 20. The sender gauge 60 is supported by the stay 40. The sender gauge 60 includes a body 61, a detecting portion 62, an arm 63, and a float 64. The body 61 includes arm portions 65, 64 that respectively extend to the outer side. The ends of the arm portions 65, 64 respectively engage with the stays 40.

The detecting portion 62 is arranged in the body 61, such that the detecting portion 62 rotatably supports the arm 63. The detecting portion 62 has a circuit pattern (not shown) that makes contact with the arm 63. The float 64 is provided to the end of the arm 63 on the opposite side of the detecting portion 62. The float 64 floats in fuel received in the fuel tank 1. The float 64 vertically moves corresponding to the liquid level of fuel in the fuel tank 1, so that the arm 63 rotates around the detecting portion 62. Thus, a condition of contact between the arm 63 and the detecting portion 62 changes, so that the liquid level of fuel is detected.

Multiple pipes 26 respectively cover the outer peripheries of the stays 40. The pipes 26 are respectively provided among the connecting portions 31 of the case 30, the arm portions 65, 66 of the body 61, and the flange 11. Each pipe 26 serves as a spacer that restricts the distances among the connecting portion 31, the body 61, and the flange 11.

Figure 2A:
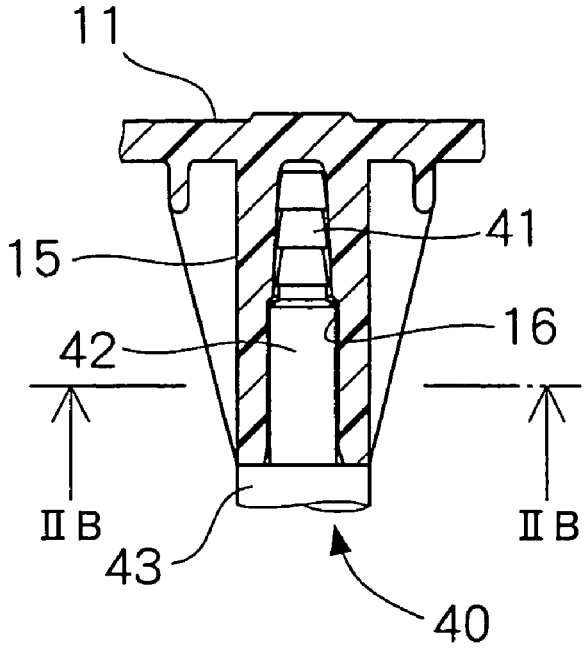
FIG. 2A is a partially cross sectional side view showing a press-inserted portion of the fuel feed apparatus.
Figure 2B:
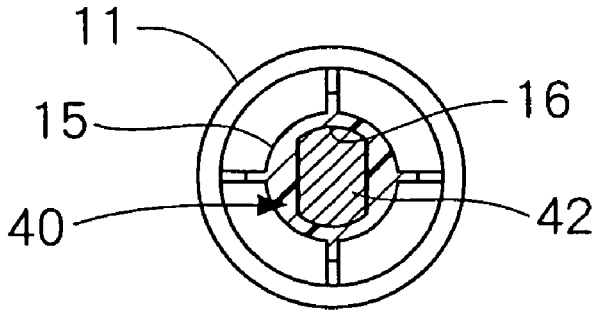
FIG. 2B is a partially cross sectional bottom view taken along the line IIB—IIB in FIG. 2A, according to the first embodiment.

Next, the connecting portion between the flange 11 and each stay 40 is described in detail. As shown in FIGS. 2A, 2B, the flange 11 has the press-inserted portion 15 that protrudes to the side of the fuel pump 20. That is, the press-inserted portion 15 protrudes to the side of the inside of the fuel tank 1.

Figure 4:
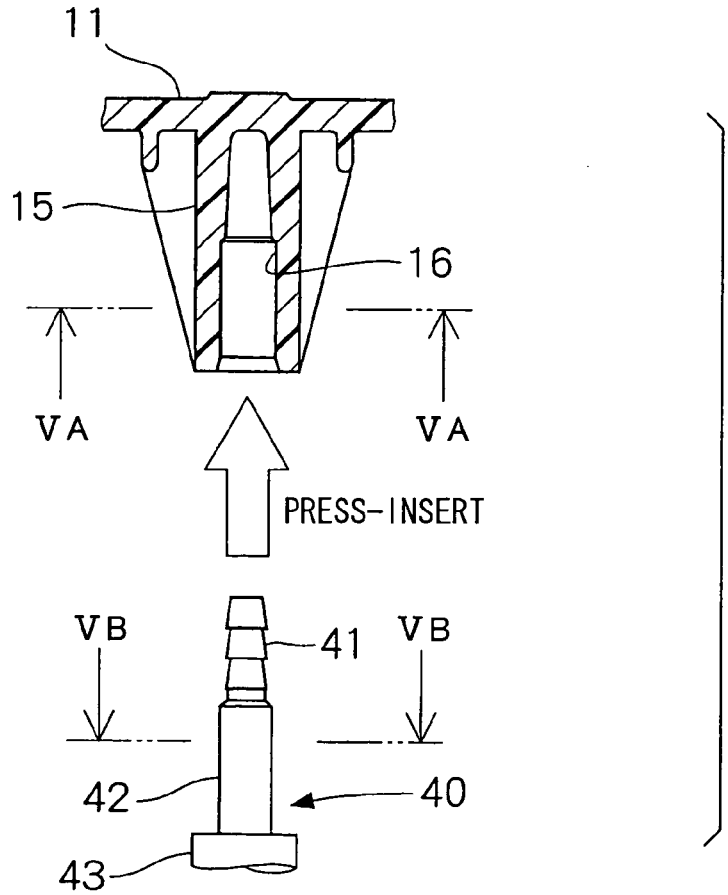
FIG. 4 is a partially cross sectional side view showing the press-inserted portion and a stay of the fuel feed apparatus, according to the first embodiment.
Figure 5A:
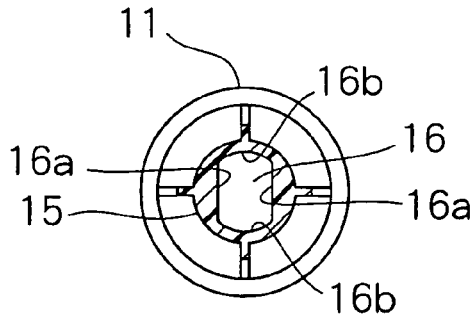
FIG. 5A is a partially cross sectional bottom view taken along the line VA—VA in FIG. 4.
Figure 5B:
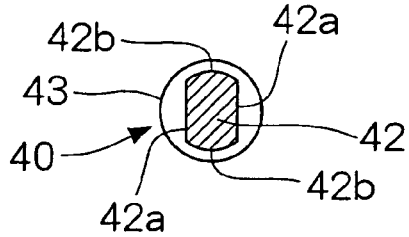
FIG. 5B is a partially cross sectional top view taken along the line VB—VB in FIG. 4, according to the first embodiment.

As show in FIGS. 4, 5A, and 5B, the press-inserted portion 15 is formed in a substantially cylindrical shape that has a hole portion 16, into which each stay 40 is press-inserted. The stay 40 has a tip end 41 and a rotation restricting portion 42 on the side of the flange 11. The tip end 41 and the rotation restricting portion 42 protrude from a column portion 43 to the side of the flange 11. The column portion 43 has a substantially constant outer diameter thereof, and constructs a large part of the stay 40. The tip end 41 of the stay 40 is formed in a stepwise shape, so that the end 41 introduces the stay 40 into the hole portion 16.

The rotation restricting portion 42 is arranged between the column portion 43 and the tip end 41. The tip end 41, the rotation restricting portion 42, and the column portion 43 are integrally formed to construct the stay 40.

As referred to FIG. 5B, the rotation restricting portion 42 has the cross section perpendicular to the axis of the rotation restricting portion 42. The cross section of the rotation restricting portion 42 is in a noncircular shape. Specifically, the axial cross section of the rotation restricting portion 42 is in a substantially oblong shape or a substantially oval shape. More specifically, the rotation restricting portion 42 has two flat faces 42*a* on both radially outer side thereof. The two flat faces 42*a* are substantially in parallel with each other. The rotation restricting portion 42 has two arc-shaped faces 42*b* that connects the two flat faces 42*a*.

As referred to FIG. 5A, the hole portion 16 of the flange 11 has the cross section that is in a substantially similar figure with respect to the axial cross section of the stay 40. That is, the cross section of the hole portion 16 is analogous to the axial cross section of the stay 40, i.e., the cross section of the hole portion 16 is geometrically similar to the axial cross section of the stay 40.

That is, the hole portion 16 of the flange 11 has the axial cross section that is in a noncircular shape such as an oblong shape and an oval shape. The flange 11 has the inner wall, which defines the hole portion 16. The inner wall of the flange 11 includes two flat faces 16*a* on both radially outer side thereof. The two flat faces 16*a* are substantially in parallel with each other. The inner wall of the flange 11 has two arc-shaped faces 16*b* that connects the two flat faces 16*a*. In a structure, in which the stay 40 is press-inserted into the press-inserted portion 15, the axial cross sectional area of the hole portion 16 of the flange 11 is substantially equal to or less than the axial cross sectional area of the rotation restricting portion 42 of the stay 40.

In a structure, in which the stay 40 is loosely inserted into the press-inserted portion 15, the axial cross sectional area of the hole portion 16 of the flange 11 may be greater than the axial cross sectional area of the rotation restricting portion 42 of the stay 40 such that the rotation restricting portion 42 of the stay 40 do not rotate in the press-inserted portion 15.

When the stay 40 is press-inserted into the hole portion 16, each flat face 42*a* of the rotation restricting portion 42 tightly makes contact with each flat face 16*a* of the hole portion 16. Thus, the stay 40 is press-inserted into the hole portion 16. That is, the flat face 42*a* of the rotation restricting portion 42 and the flat face 16*a* of the hole portion 16 serve press-insertion faces. The arc-shaped face 42*b* of the rotation restricting portion 42 and the arc-shaped face 16*b* of the hole portion 16 do not exert influence to the press-insertion. The stay 40 is press-inserted into the press-inserted portion 15, so that the stay 40 connects to the flange 11.

The stay 40 is press-inserted into the flange 11, so that the flat face 42*a* of the rotation restricting portion 42 tightly makes contact with the flat face 16*a* of the hole portion 16, after the press-insertion. The rotation restricting portion 42 and the hole portion 16 respectively have cross sections that are in noncircular shapes. Therefore, even force is applied to the stay 40 to rotate the stay 40 in the circumferential direction, the stay 40 is restricted from rotating with respect to the flange 11 by the contact between the flat face 42*a* of the rotation restricting portion 42 and the flat face 16*a* of the hole portion 16.

In this first embodiment, as referred to FIG. 3, the imaginary straight line, which connects the connecting portions 31 of the case 30 therebetween, departs from the center of the case 30 that accommodates the fuel pump 20. Therefore, an imaginary straight line that connects the two stays 40 is away from the center of the case 30, which accommodates the fuel pump 20, and the center of the flange 11. Thus, the two stays are arranged eccentrically with respect to the fuel pump 20 and the flange 11. Here, FIG. 3 is a schematic view for briefly explaining the structure, in which the stays 40 are eccentrically arranged relative to the case 30. Components of the fuel feed apparatus 10 such as the discharge pipe 12, the electric connecter 13, and the sender gauge 60 are not depicted in FIG. 3. The shape of components of the fuel feed apparatus 10 are simplified in FIG. 3, and details of the fuel feed apparatus 10 are not specifically depicted in FIG. 3.

The two stays 40 are arranged eccentrically with respect to the fuel pump 20 and the flange 11, so that torsion arising between the flange 11 and the case 30, which accommodates the fuel pump 20, are allowed in a predetermined range. Therefore, even when the flange 11 is twisted with respect to the case 30, the twist is absorbed by eccentricity among the stays 40, the flange 11 and the case 30. As a result, even when the flange 11 is twisted with respect to the case 30, the rotative force applied to the end of the stays 40 on the side of the flange 11 becomes small. Therefore, the stays 40 can be restricted from rotating in the circumferential direction thereof.

When the case 30, which receives the fuel pump 20, is suspended from the flange 11 via the stays 40 in the fuel feed apparatus 10 in this embodiment, torsion is apt to arise between the flange 11 and the case 30. When torsion arises, force is applied to a base portion of the stays 40, i.e., to the ends of the stays 40 on the side of the flange 11. As a result, the stays 40 are respectively rotated in the circumferential direction thereof. By contrast, in this embodiment, each stay 40 has the rotation restricting portion 42 that restricts the stay 40 from rotating relative to the press-inserted portion 15 of the flange 11. Therefore, the stays 40 are restricted from rotating by the rotation restricting portion 42, even when circumferential force acts onto the stays 40. Thus, the stays 40 can be restricted from rotating without using an additional member.

In this embodiment, the flat faces 42*a* and the flat faces 16*a* are formed in the rotation restricting portion 42 of each stay 40 and each hole portion 16 of the flange 11. Therefore, press-insertion between the stay 40 and the flange 11 is maintained by a large force caused by contact between the flat faces 42*a* and the flat faces 16*a*. Thus, the stay 40 can be steadily restricted from rotating in the circumferential direction thereof. That is, the stay 40 can be steadily restricted from rotating around the longitudinal axis of the stay 40.

(Second and Third Embodiments)

In the second and third embodiments, the cross sectional shapes of the rotation restricting portions of the stays 40 and the hole portions of the flange 11 are different from those in the first embodiment.

Figure 6A:
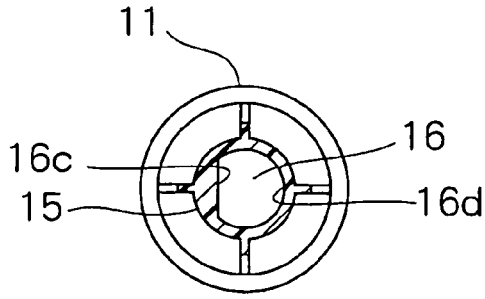
FIG. 6A is a partially cross sectional bottom view showing a press-inserted portion of a fuel feed apparatus.
Figure 6B:
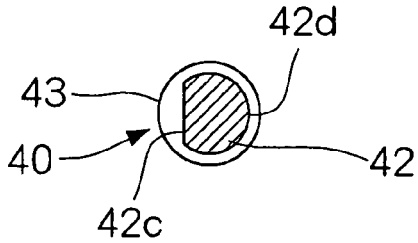
FIG. 6B is a partially cross sectional top view showing a tip end of a stay, according to a second embodiment of the present invention.

In the second embodiment, as shown in FIG. 6B, the rotation restricting portion 42 has the axial cross sectional shape that is in a substantially D-shape. Specifically, the rotation restricting portion 42 of the stay 40 has one flat face 42*c* and an arc face 42*d*. The arc face 42*d* connects both end portions of the flat face 42*c*. As shown in FIG. 6A, the hole portion 16 of the flange 11 has the axial cross section that is a similar figure with respect to the axial cross section of the rotation restricting portion 42 of the stay 40. Specifically the hole portion 16 of the flange 11 has one flat face 16*c* and an arc face 16*d*. The arc face 16*d* connects both end portions of the flat face 16*c*.

In the second embodiment, the rotation restricting portion 42 of the stay 40 and the hole portion 16 of the flange 11 respectively have one flat face 42*c* and one flat face 16*c*. Therefore, press-insertion between the stay 40 and the flange 11 is maintained by a large force caused by contact between the flat face 42*c* and the flat face 16*c*. Besides, the stay 40 is restricted from rotating by contact between the flat face 42*c* and the flat face 16*c*. Thus, the stay 40 can be steadily restricted from rotating in the circumferential direction thereof.

Figure 7A:
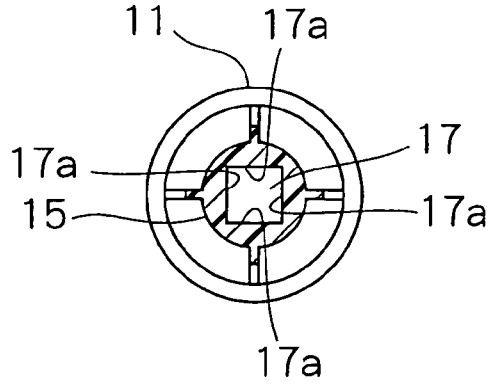
FIG. 7A is a partially cross sectional bottom view showing a press-inserted portion of a fuel feed apparatus.
Figure 7B:
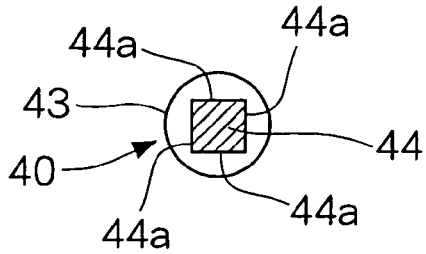
FIG. 7B is a partially cross sectional top view showing a tip end of a stay, according to a third embodiment of the present invention.

In the third embodiment, as shown in FIG. 7B, a rotation restricting portion 44 has the axial cross sectional shape that is in a substantially rectangular shape. Specifically, the rotation restricting portion 44 of the stay 40 has two pairs of flat faces 44*a*. That is, the rotation restricting portion 44 has four flat faces 44*a*. The flat faces, which are opposite to each other, are substantially parallel to each other. As shown in FIG. 7A, a hole portion 17 of the flange 11 has the axial cross section that is a similar figure with respect to the axial cross section of the rotation restricting portion 44 of the stay 40. Specifically the hole portion 17 of the flange 11 has four flat faces 17*a*.

In the third embodiment, the rotation restricting portion 44 of the stay 40 and the hole portion 17 of the flange 11 respectively have the four flat faces 44*a* and the four flat faces 17*a*. Therefore, press-insertion between the stay 40 and the flange 11 is maintained by a large force caused by contact between the four flat faces 44*a* and the four flat faces 17*a*. Besides, the stay 40 is restricted from rotating by contact between the flat faces 44*a* and the flat faces 17*a*. Thus, the stay 40 can be steadily restricted from rotating in the circumferential direction thereof. That is, in the above first to the third embodiments, the stay 40 can be steadily restricted from rotating around the longitudinal axis of the stay 40.

As described in the above first to the third embodiments, a substantially oblong shape, a substantially D-shape, and a substantially rectangular shape are applied to the cross sectional shapes of the rotation restricting portions 42, 44 and the hole portions 16, 17 as examples. However, the axial cross sectional shapes are not limited to the above shapes. Any noncircular shapes such as a polygonal shape, a star-shape, and an oval shape may be applied to the cross sectional shapes of the rotation restricting portions 42, 44 and the hole portions 16, 17.

(Fourth and Fifth Embodiments)

In the fourth and fifth embodiments, the cross sectional shapes of the rotation restricting portions of the stays 40 and the hole portions of the flange 11 are different from those in the first to third embodiments. In the structures of the fourth and fifth embodiments, the axial cross sectional shapes of the hole portions of the flange 11 may be a circular shape similarly to a conventional structure.

Figure 8:
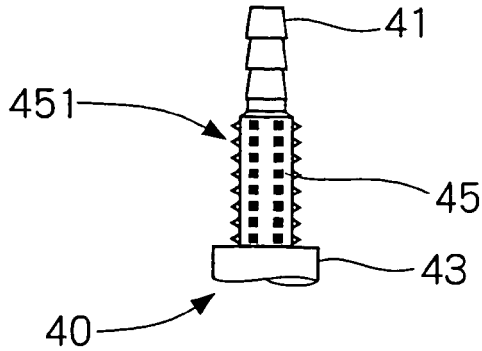
FIG. 8 is a side view showing a tip end of a stay of a fuel feed apparatus, according to a fourth embodiment of the present invention.

As shown in FIG. 8, in the fourth embodiment, each stay 40 has a rotation restricting portion 45 that has protruding portions 451. When the stay 40 is press-inserted into the press-inserted portion 15 of the flange 11, the protruding portions 451 dig into the inner wall of the press-inserted portion 15 of the flange 11 that internally forms the hole portion, into which the stay 40 is press-inserted. The protruding portions 451 include multiple protrusions, which are in splinter (thorn) shapes, regularly or irregularly formed on the rotation restricting portion 45, so that multiple protruding portions 451 are formed on the rotation restricting portion 45.

In the fourth embodiment, the protruding portions 451 are formed on the rotation restricting portion 45, so that the protruding portions 451 dig into the inner wall of the press-inserted portion 15 of the flange 11 when the stay 40 is press-inserted into the press-inserted portion 15 of the flange 11. The touch area between the stay 40 and the flange 11 increases, so that friction is enhanced between the stay 40 and the flange 11. Thereby, the stay 40 is restricted from moving in the circumferential direction thereof. Thus, the stay 40 can be restricted from circumferentially rotating.

Figure 9A:
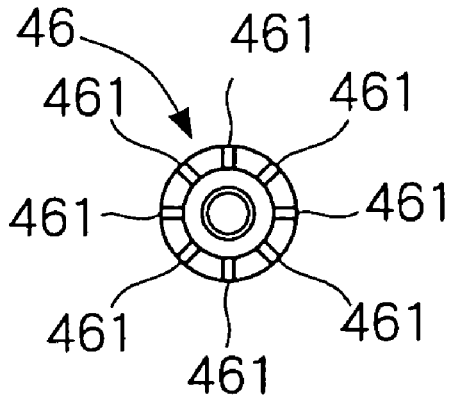
FIG. 9A is a top view showing a tip end of a stay of a fuel feed apparatus.
Figure 9B:
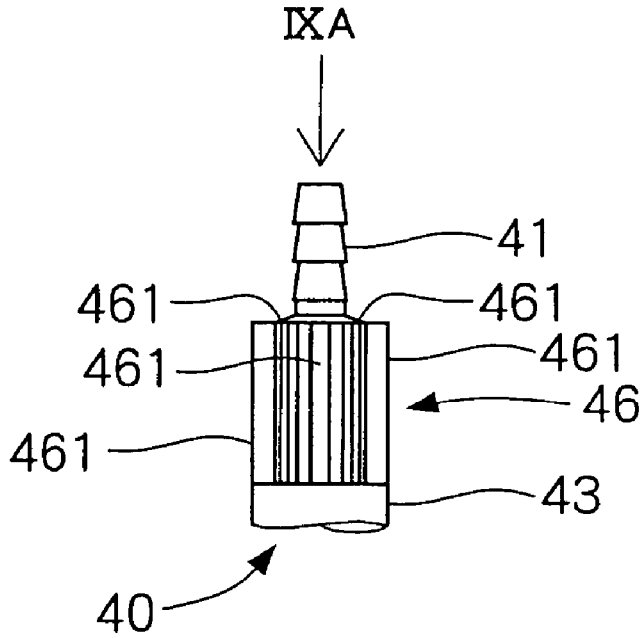
FIG. 9B is a side view showing the tip end of the stay, according to a fifth embodiment of the present invention.

As shown in FIG. 9, in the fifth embodiment, each stay 40 has a rotation restricting portion 46 that has protruding portions 461. When the stay 40 is press-inserted into the press-inserted portion 15 of the flange 11, the protruding portions 461 dig into the inner wall of the press-inserted portion 15 of the flange 11 that internally forms the hole portion, into which the stay 40 is press-inserted. The protruding portions 461 are formed on the rotation restricting portion 46 along the circumferential direction in a discontinuous manner. Thereby, the protruding portions 461 radially outwardly protrude from the rotation restricting portion 46. The protruding portions 461 are formed on the rotation restricting portion 46 axially throughout the lengthwise direction of the rotation restricting portion 46.

The protruding portions 461 may be partially formed on the rotation restricting portion 46 axially with respect to the lengthwise direction of the rotation restricting portion 46. The protruding portions 461 may be formed on the rotation restricting portion 46 axially with respect to the lengthwise direction of the rotation restricting portion 46 in a discontinuous manner.

The protruding portions 461 are not limited to be formed on the rotation restricting portion 46 regularly in the circumferential direction thereof. The protruding portions 461 may be formed on the rotation restricting portion 46 irregularly in the circumferential direction thereof.

In the fifth embodiment, the protruding portions 461 are formed on the rotation restricting portion 46, so that the protruding portions 461 dig into the inner wall of the press-inserted portion 15 of the flange 11 when the stay 40 is press-inserted into the press-inserted portion 15 of the flange 11. Thus, the touch area between the stay 40 and the flange 11 increases, so that friction is enhanced between the stay 40 and the flange 11. Thereby, the stay 40 is restricted from moving in the circumferential direction thereof. Thus, the stay 40 can be restricted from circumferentially rotating. In the above fourth and fifth embodiments, the stay 40 can be steadily restricted from rotating around the longitudinal axis of the stay 40.

The shape and structure of the protruding portion are not limited to the above shape and structure. The protruding portion may have any shapes and structures, in which the protruding portion dig into the inner wall of the press-inserted portion of the flange when the stay is press-inserted into the press-inserted portion of the flange.

(Variation)

The above structures of the present invention may be applied to a fuel feed apparatus that includes a sub-tank having a bottom portion making contact with a bottom wall of a fuel tank.

The structures and methods of the above embodiments can be combined as appropriate. For example, the fourth and fifth embodiments can be combined to form a combined protruding portion on the rotation restricting portion of the stay.

Various modifications and alternations may be diversely made to the above embodiments without departing from the spirit of the present invention.

What is claimed is:

1. A fuel feed apparatus comprising:

a flange that covers an opening of a fuel tank;

a fuel pump that is accommodated in the fuel tank, the fuel pump pumping fuel in the fuel tank to an outside of the fuel tank; and at least one stay that has a first end, which connects with the flange, the at least one stay having a second end, the at least one stay supporting the fuel pump in the fuel tank on the side of the second end, wherein the flange has a hole portion on a side of the fuel pump, the hole portion of the flange receives the first end of the at least one stay, the first end of the at least one stay being on an opposite side of the fuel pump, the first end, which is received in the hole portion, has a rotation restricting portion that restricts the at least one stay from rotating in a circumferential direction of the at least one stay, the rotation restricting portion has a cross section, which is perpendicular to an axis of the at least one stay, the cross section of the rotation restricting portion is in a noncircular shape, and the hole portion has a cross section that is substantially similar to the cross section of the rotation restricting portion.

2. The fuel feed apparatus according to claim 1, wherein the cross section of the rotation restricting portion is in a substantially oblong shape that has two sides, which are substantially in parallel with each other.

3. The fuel feed apparatus according to claim 1, wherein the cross section of the rotation restricting portion is in a substantially D-shape that is formed of an arc and a substantially straight line.

4. The fuel feed apparatus according to claim 1, wherein the cross section of the rotation restricting portion is in a substantially rectangular shape that is formed of two pairs of two sides, which are opposed to each other, and the two sides, which are opposed to each other, are substantially in parallel with each other.

5. The A fuel feed apparatus comprising:

a flange that covers an opening of a fuel tank;

a fuel pump that is accommodated in the fuel tank, the fuel pump pumping fuel in the fuel tank to an outside of the fuel tank; and at least one stay that has a first end, which connects with the flange, the at least one stay having a second end, the at least one stay supporting the fuel pump in the fuel tank on the side of the second end, wherein the flange has a hole portion on a side of the fuel pump, the hole portion of the flange receives the first end of the at least one stay, the first end of the at least one stay being on an opposite side of the fuel pump, the first end, which is received in the hole portion, has a rotation restricting portion that restricts the at least one stay from rotating in a circumferential direction of the at least one stay, the rotation restricting portion has at least one protruding portion on an outer wall of the rotation restricting portion, and the protruding portion digs into an inner wall that defines the hole portion.

6. The fuel feed apparatus according to claim 5, wherein the at least one protruding portion includes a plurality of protruding portions, the plurality of protruding portions is formed on the outer wall of the rotation restricting portion, and each protruding portion is formed in a substantially splinter shape.

7. The fuel feed apparatus according to claim 5, wherein the at least one protruding portion includes a plurality of protruding portions, and the plurality of protruding portions is formed in a substantially circumferential direction of the rotation restricting portion in a discontinuous manner.

8. The fuel feed apparatus according to claim 1, wherein the at least one stay includes two stays that form an imaginary straight line therebetween, and the imaginary straight line is away from a center of the fuel pump.

9. The fuel feed apparatus according to claim 5, wherein the at least one stay includes two stays that form an imaginary straight line therebetween, and the imaginary straight line is away from a center of the fuel pump.

* * * * *